United States Patent [19]

Takahashi et al.

[11] 4,229,619

[45] Oct. 21, 1980

[54] METHOD AND APPARATUS FOR DRIVING A MULTI WAY SPEAKER SYSTEM

[75] Inventors: Nobuaki Takahashi; Eiichi Funasaka; Masanobu Shinozaki; Yasuo Kaizu, all of Yokohama, Japan

[73] Assignee: Victor Company of Japan, Limited, Yokohama, Japan

[21] Appl. No.: 956,265

[22] Filed: Oct. 31, 1978

[30] Foreign Application Priority Data

| | | | |
|---|---|---|---|
| Nov. 1, 1977 | [JP] | Japan | 52/131010 |
| Nov. 1, 1977 | [JP] | Japan | 52/131011 |
| Nov. 1, 1977 | [JP] | Japan | 52/131012 |
| Nov. 1, 1977 | [JP] | Japan | 52/131013 |
| Nov. 10, 1977 | [JP] | Japan | 52/134967 |
| Nov. 14, 1977 | [JP] | Japan | 52/136523 |

[51] Int. Cl.[2] ..... H04R 3/00

[52] U.S. Cl. ..... 179/1 D; 179/1 F; 179/1 GP; 330/109

[58] Field of Search ..... 179/1 D, 1 F, 1 GP; 330/84, 126, 109, 294, 304, 306

[56] References Cited

U.S. PATENT DOCUMENTS

| | | | |
|---|---|---|---|
| 3,798,374 | 3/1974 | Meyers | 179/1 F |
| 3,821,473 | 6/1974 | Mullins | 179/1 F |
| 3,889,060 | 6/1975 | Goto et al. | 179/1 D |
| 3,924,072 | 12/1975 | Turner et al. | 179/1 GP |
| 4,118,600 | 10/1978 | Stahl | 179/1 D |

FOREIGN PATENT DOCUMENTS

| | | | |
|---|---|---|---|
| 174223 | 3/1953 | Austria | 179/1 GP |

*Primary Examiner*—Malcolm A. Morrison
*Assistant Examiner*—E. S. Kemeny
*Attorney, Agent, or Firm*—Lowe, King, Price & Becker

[57] ABSTRACT

A multi way speaker system comprises an amplifier, frequency dividing network including a plurality of filters, a plurality of speakers respectively responsive to the output signals of the filters, and a summing circuit responsive to the output signals of the filters for producing a composite signal to be fed back to the input of the amplifier to establish a negative feedback loop. Because of the feedback loop undesirable influences by various elements included in the filters are diminished and thus the speakers reproduce audio frequencies with high fidelity. At least one equalizer may be employed in the feedback loop, while auxiliary filters may be used in such a manner that the output terminals of the auxiliary filters are connected to only the summing circuit so that the output signals of the auxiliary filters are added to an output signal of at least one filter of the frequency dividing network. In order to supply the network with the output signal of the amplifier and to feed the composite signal back to the amplifier a three-wire coaxial cable may be used. The three-wire coaxial cable is used in such a manner that the composite signal flows through a conductor which is shielded by another conductor carrying the output signal of the amplifier. A switch and a resistor network may be used in the feedback loop for avoiding undesirable oscillation and output level variation.

23 Claims, 13 Drawing Figures

METHOD AND APPARATUS FOR DRIVING A MULTI WAY SPEAKER SYSTEM

FIELD OF THE INVENTION

The present invention generally relates to a method and apparatus for driving a speaker system. More specifically, the present invention relates to such a system which comprises a plurality of speakers for multi way reproduction of audio frequencies.

BACKGROUND OF THE INVENTION

In a conventional so called Hi-Fi audio system, a plurality of speakers, such as a tweeter, a squeaker (mid-range speaker) and a woofer, are employed for reproducing audio frequencies. These speakers are usually disposed in an enclosure and are supplied with respective signals which are obtained via a suitable frequency dividing network, such as a high-pass filter, a band-pass filter and a low-pass filter. These filters are fed with a signal which is produced in a suitable amplifier, the output impedance of which is designed to be as low as possible so that the damping factors of the speakers are large enough to perfectly reproduce the audio frequencies divided by the filters.

However, since each of the above mentioned filters comprises at least one capacitor and/or a coil, it is difficult to obtain an adequate damping factor due to the equivalent series resistance of the capacitor and/or the coil. Further, since the reactance of the capacitor is apt to undesirably vary in accordance with the variation of the frequency and the voltage applied thereto, distortion may occur by the filters, i.e the dividing network. When iron or other magnetic member is used as the core of the above mentioned coil, distortion may occur due to various reasons such as the variation of the magnetic permeability in accordance with the variation of the density of the magnetic flux that passes through the magnetic member. Moreover, since the magnetic member has hysteresis, this causes the filter to produce distortion and deteriorate the phase propagation characteristics.

From the foregoing, it will be understood that the filters used in the frequency dividing network interposed between an amplifier and the plurality of speakers, cause the speakers to deteriorate the damping characteristics thereof, while the distortion produced by the filters are directly reproduced by the speakers. In other words, frequency dividing networks have been an obstacle for the high fidelity audio reproduction.

SUMMARY OF THE INVENTION

The present invention has been developed in order to overcome the above mentioned drawbacks of the conventional multi way speaker system. In accordance with the present invention, a feedback signal is produced in response to filter output signals so as to be fed back to an input of the amplifier to establish a negative feedback loop.

It is therefore an object of the present invention to provide an improved multi way speaker system in which the distortion due to the frequency dividing network is effectively prevented.

Another object of the present invention is to provide such a system in which the damping characteristics of the speakers are improved.

Further object of the present invention is to provide such a system in which the audio frequencies are reproduced with high fidelity.

In accordance with a first feature of the present invention, a summing circuit is used in combination with a conventional multi way speaker system. The summing circuit produces a composite signal by combining the output signals of filters included in the frequency dividing network which is interposed between an amplifier and a plurality of speakers. The composite signal produced by the summing circuit is fed back to the input of the amplifier so as to establish a negative feedback loop.

In accordance with a second feature of the present invention, a plurality of equalizers are used in addition to the summing circuit. Each equalizer is interposed between the output terminal of each filter, i.e. the input terminal of each speaker, and the input terminal of the summing circuit.

In accordance with a third feature of the present invention, auxiliary filters are employed in addition to the filters of the frequency dividing network. The output signals of the auxiliary filters are used only for producing a composite signal which is produced by summing the output signals of the auxiliary filters and at least one filter included in the frequency dividing network.

In accordance with a fourth feature of the present invention, a three-wire coaxial cable is used to establish the connections between the amplifier and the speakers. The composite signal, which is to be fed back to the amplifier, flows through a conductor which is shielded by another conductor carrying the output signal of the amplifier so as to avoid undesirable oscillation.

In accordance with a fifth feature of the present invention, a switch and a resistor network are provided in the negative feedback loop so that the system does not oscillate or the output level does not vary although the composite signal is not fed back to the amplifier.

BRIEF DESCRIPTION OF THE DRAWINGS

These and other objects and features of the present invention will become more readily apparent from the following detailed description of the preferred embodiments taken in conjunction with the accompanying drawings in which.

The same elements used in various embodiments are denoted by the same reference numerals throughout the figures and the specification.

DETAILED DESCRIPTION OF THE PREFERRED EMBODIMENTS

Figure 1:
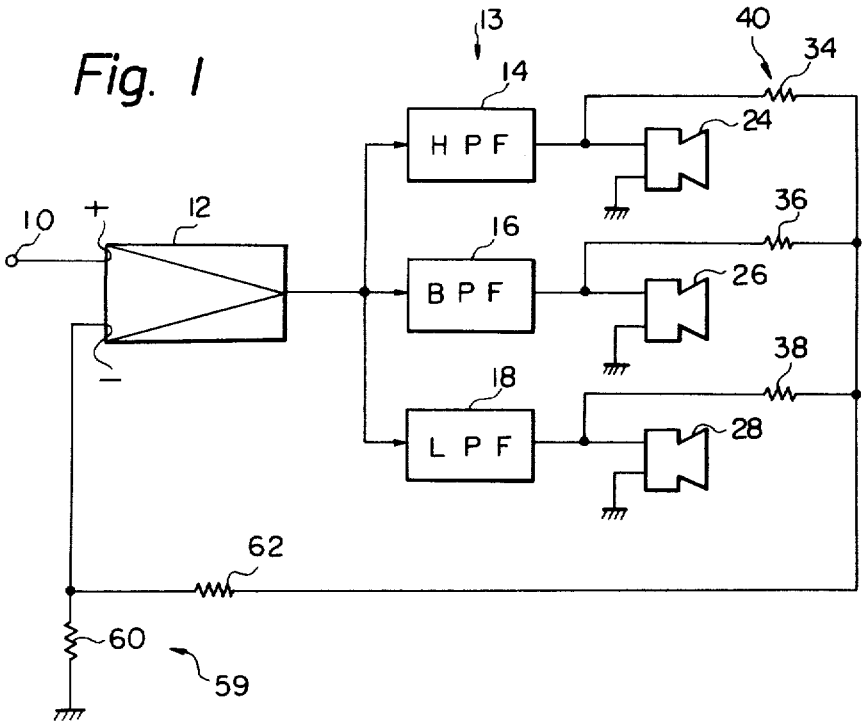
FIG. 1 shows in schematic diagram a first preferred embodiment of the multi way speaker system according to the present invention.

Reference is now made to FIG. 1 which shows a schematic diagram of the first preferred embodiment of the multi way speaker system according to the present invention. The circuitry arrangement shown in FIG. 1 consists of an amplifier 12, a frequency dividing network 13, a plurality of speakers 24, 26 and 28, a summing circuit 40, and a voltage divider 59. The frequency dividing network 13 consists of three filters, i.e. a high-pass filter 14, a band-pass filter 16, and a lowpass filter 18, while the summing circuit 40 consists of first, second and third resistors 34, 36 and 38. The first speaker 24 connected to the high-pass filter 14 is a tweeter and is arranged to reproduce only high frequency audio signals such as over 3000 Hz. The second speaker 26 connected to the band-pass filter 16 is a squeaker (midrange speaker) and is arranged to reproduce only a middle range frequencies such as between 300 Hz and 3000 Hz. The third speaker 28 connected to the low-pass filter 18 is a woofer and is arranged to reproduce only low frequency audio signals such as below 300 Hz.

The amplifier 12 has a noninverting input "+" and an inverting input "−", where the noninverting input + is connected to an input terminal 10 for receiving an audio signal to be amplified and the inverting input − is connected to ground via a resistor 60 included in the above mentioned voltage divider 59. The output of the amplifier 12 is connected to each of the input terminals of the high-pass, band-pass and low-pass filters 14, 16 and 18. The output terminals of the three filters 14, 16 and 18 are respectively connected to the tweeter 24, the squeaker 26 and the woofer 28 as mentioned hereinabove, while each of the other input terminals of the three speakers 24, 26 and 28 is connected to ground. Each of the output terminals of the three filters 14, 16 and 18 is further connected to respective resistors 34, 36 and 38 included in the summing circuit 40. These three resistors 34, 36 and 38 are connected to each other at the other ends thereof so as to produce an added signal and the junction (no numeral) connecting these three resistors 34, 36 and 38 is further connected, via a resistor 62 included in the voltage divider 59, to the inverting input − of the amplifier 12. The added signal obtained at the output, i.e. the junction, of the summing circuit 40 is referred to as a composite signal hereinafter throughout the specification.

The high-pass filter 14 may consist of a capacitor (not shown) and is arranged to have a predetermined attenuation slope below a predetermined frequency, while the band-pass filter 16 may consist of a series circuit of a capacitor and a coil (both are not shown), and is arranged to have a first attenuation slope over a predetermined frequency and a second attenuation slope below a predetermined frequency. The low-pass filter may consist of a coil (not shown) and is arranged to have a predetermined attenuation slope over a predetermined frequency.

Figure 2:
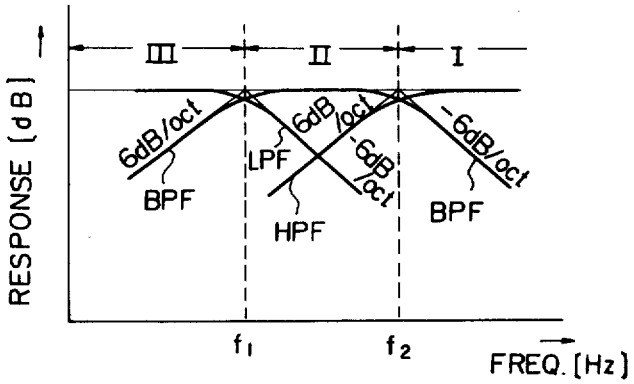
FIG. 2 shows a graphical diagram the frequency characteristics of the filters shown in FIG. 1.

FIG. 2 illustrates the frequency characteristics of the three filters 14, 16 and 18. It will be seen in FIG. 2 that the full range of the audio frequencies is divided into three ranges, i.e. a high-frequency range I, a middle-frequency range II and a low-frequency range III. The crossover frequency between the middle and low frequency ranges II and III is denoted by a reference $f_1$, while the other crossover frequency between the high and middle frequency ranges I and II is denoted by a reference $f_2$.

As shown in FIG. 2, the attenuation slope of the frequency characteristics of the high-pass filter 14 is 6 dB/oct in a range below the crossover frequency $f_2$, the first attenuation slope of the frequency characteristics of the bandpass filter 16 is −6 dB/oct in a range over the crossover frequency $f_2$, while the second attenuation slope of the same is 6 dB/oct in a range below the other crossover frequency $f_1$, and the attenuation slope of the frequency characteristics of the low-pass filter 18 is −6 dB/oct in a range over the other crossover frequency $f_1$.

It will be noted that if the circuit arrangement shown in FIG. 1 is not equipped with the summing circuit 40 while an output signal of the amplifier 12 is directly fed back to the inverting input − thereof, the circuit is the same as the conventional system in construction.

The summing circuit 40 is provided for producing a composite signal by adding three output signals of the three filters 14, 16 and 18. Since the composite signal produced by the summing circuit 40 is similar to that produced by a circuit having a transfer function of one (unity) in response to the output signal of the amplifier 12, the composite signal may be a suitable feedback signal to be fed to the inverting input − of the amplifier 12. As shown in FIG. 1, the composite signal obtained by the summing circuit 40 is fed via the voltage divider 59 to the inverting input − of the amplifier 12 so that the voltage of the composite signal is reduced to a predetermined extent defined by the ratio of the resistances of the resistors 60 and 62 included in the voltage divider 59.

With this provision, since signals for driving the respective speakers are included in the negative feedback loop, the deterioration of the damping factor due to the equivalent series resistance included in the capacitors and coils of the filters 14, 16 and 18 is compensated for, while the distortion of the audio signals due to the characteristics of the capacitors and coils is also reduced. In other words, the signals for driving the three speakers are the same, in corresponding frequency ranges, as the components of the input signal of the amplifier 12 in the waveform thereof.

Figure 3:
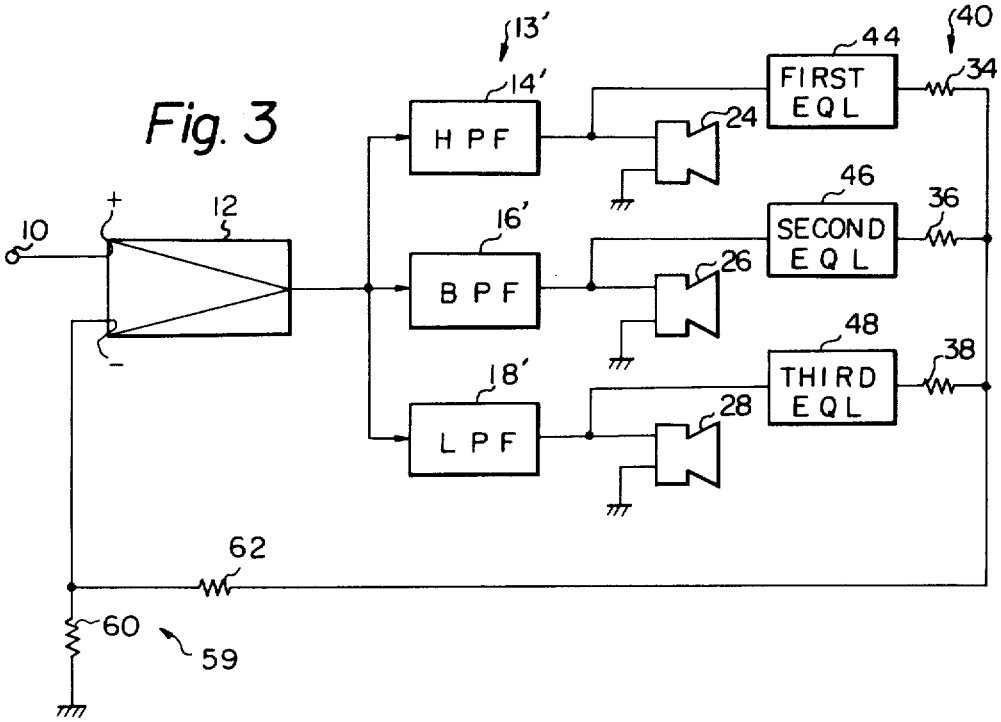
FIG. 3 shows in schematic diagram a second preferred embodiment of the multi way speaker system according to the present invention.

Reference is now made to FIG. 3 which shows a schematic diagram of the second preferred embodiment of the multi way speaker system according to the present invention. The circuit arrangement shown in FIG. 3 is similar to that of the first embodiment except that three equalizers 44, 46 and 48 are interposed between the three filters 14', 16' and 18' and the three resistors 34, 36 and 38 included in the summing circuit 40.

The high-pass filter 14' has an attenuation slope of 12 dB/oct which is different from that of the high-pass filter 14 used in the first embodiment. In the same manner the band-pass filter 16' has first and second attenuation slopes of 12 dB/oct and −12 dB/oct, while the low-pass filter 18' has an attenuation slope of −12 dB/oct. Since the attenuation slope of each of the filters 14', 16' and 18' is much steeper than those of the filters 14, 16 and 18 used in the first embodiment, the speakers 24, 26 and 28 reproduce audio frequencies with much high fidelity compared to the first embodiment. It is generally known that steep slopes of the attenuation of each of the filters used in a frequency dividing network is advantageous for reducing cross talk and interference between the speakers. When the attenuation slope is not steep enough, the audio frequencies emitted from at least two speakers interfere with each other in the space of front of the speakers, and thus the distribution of the sound pressure level is not equal throughout the space since the audio frequencies are composed either in phase or opposite phase at each of the listening points in the sound field. Further, so called partial vibrations are apt to occur in the woofer 28 when a signal the frequency of which is higher than the low frequency range, is undesirably applied to the woofer 28.

Although it is advantageous to use filters having steep slopes, such filters can not take the place of filters 14, 16 and 18 shown in FIG. 1 because of the high degree of phase shift. When the filters having attenuation slopes of 12 dB/oct and/or −12 dB/oct, the phase shift of the signal obtained via each of the filters is about 65 degrees with respect to the input signal at a point of −3 dB, while the phase shift is 45 degrees in case that filters having attenuation slopes of 6 dB/oct and/or −6 dB/oct are used. Further, the phase shift of the output signal of the filters is as much as 90 degrees at a point of −6 dB when the slopes of the attenuation of the filters is 12 dB/oct and/or −12 dB/oct. Therefore, when filters having attenuation slopes of 12 dB/oct and or −12 dB/oct are used instead of the filters 14, 16 and 18 shown in FIG. 1, where the output signals of the filters are added to each other by the summing circuit 40 to be fed back to the inverting input − of the amplifier 12, it is impossible to obtain a composite signal having small phase shift, such as less than ±30 degrees, and flat frequency characteristics with respect to the output signal of the amplifier 12.

When negative feedback is performed in response to such filter output signals with large phase shift, the frequency characteristics of the output signal of the amplifier 12 is modified in the opposite direction with respect to the correct direction for the compensation, so as to increase the irregularity of the frequency characteristics. Further, when the phase shift of the output signal of the filters is over 90 degrees, the feedback loop is apt to oscillate since positive feedback is performed instead of negative feedback.

It will be understood that the first, second and third equalizers 44, 46 and 48 are additionally provided for overcome the above mentioned problems in the second embodiment.

Figure 4:
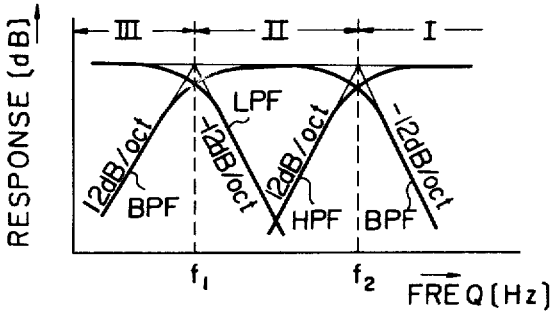
FIG. 4 shows in graphical diagram the frequency characteristics of the filters shown in FIG. 3.
Figure 5:
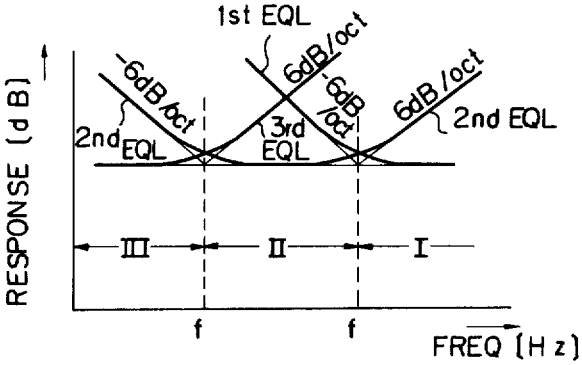
FIG. 5 shows in graphical diagram the frequency characteristics of the equalizers shown in FIG. 3.

FIG. 4 and FIG. 5 respectively show the frequency to response characteristics of the three filters 14', 16' and 18' and the first, second and third equalizers 44, 46 and 48. As shown in FIGS. 4 and 5, the attenuation slopes of the high-pass, band-pass and low-pass filters 14', 16' and 18' are 12 dB/oct and/or −12 dB/oct, while the equalizers 44, 46 and 48 respectively have inverse frequency characteristics to those of the filters 14', 16' and 18' and the equalizing slopes of the first, second and third equalizers 44, 46 and 48 are 6 dB/oct and −6 dB/oct. The first, second and third frequency ranges I, II and III of the filter network 13' including the three filters 14', 16' and 18' are arranged to correspond to the frequency ranges of the first, second and third equalizers 44, 46 and 48, where the respective crossover frequencies $f_1$ and $f_2$ in both frequency characteristics shown in FIG. 4 and FIG. 5 respectively correspond to each other.

Since each of the first, second and third equalizers 44, 46 and 48 is respectively responsive to the output signal of each of the high-pass, band-pass and low-pass filters 14', 16' and 18', the output signal of each of the first, second and third equalizers 44, 46, 48 has (an) attenuation slope(s) of 6 dB/oct and/or −6 dB/oct. It will be noted that the frequency characteristics of the output signals of the first, second and third equalizers 44, 46 and 48 are the same as those of the output signals of the three filters 14, 16 and 18 used in the first embodiment, where the frequency characteristics are shown by FIG. 2.

In other words, the frequency characteristics of the output signals of the first, second and third filters 14', 16' and 18' are respectively modified by the first, second and third equalizers 44, 46 and 48, and thus the modified output signals of the three equalizers 44, 46 and 48 are fed to resistors 34, 36 and 38 of the summing circuit 40. Since the attenuation slopes of the output signals of the first, second and third equalizers 44, 46 and 48 are 6 dB/oct and/or −6 dB/oct, the following stages of the three equalizers 44, 46 and 48 function in the same manner as in the first embodiment. Namely, since the output signals of the first, second and third equalizers 44, 46 and 48 are simply added to each other by resistors 34, 36 and 38 to produce a composite signal, the output signal, i.e. the composite signal, of the summing circuit 40 is approximately equal to a signal which may be obtained via circuit having a transfer function of one (unity) with respect to the output signal of the amplifier 12.

Accordingly, the amplitude variation of the composite signal with respect to the amplitude of the output signal of the amplifier 12, is almost constant throughout the operating frequency range, while the phase shift of the output signal of the summing circuit 40 with respect to the output signal of the amplifier 12 is negligibly small. Therefore, the composite signal obtained by the summing circuit 40 is suitable for a feedback signal.

Although in the second embodiment, it is described that the attenuation slopes of the three filters 14', 16' and 18' are 12 dB/oct and/or −12 dB/oct, while the equalizing slopes of the frequency characteristics are 6 dB/oct and/or −6 dB/oct, different filters having attenuation slopes other than 12 dB/oct and/or −12 dB/oct may be employed instead. For instance, filters having attenuation slopes of 18 dB/oct and/or −18 dB/oct may be used for the high-pass, band-pass and low-pass filters 14', 16' and 18' shown in FIG. 3. When such filters are used, the frequency characteristics of the first, second and third equalizers 44, 46 and 48 should be changed to 12 dB/oct and/or −12 dB/oct so as to obtain output signals respectively having attenuation slopes of 6 dB/oct and/or −6 dB/oct. In other words, the frequency characteristics of the first, second and third equalizers 44, 46 and 48 are selected so as to produce output signals having attenuation slopes of 6 dB/oct and/or −6 dB/oct. In other words, the equalization slopes of the equalizers 44, 46 and 48 are so selected that each of the sum of each of the attenuation slopes and each of the equalization slopes, in a corresponding frequency range, equals 6 dB/oct and/or −6 dB/oct.

In the above described first and second embodiments of the multi way speaker system according to the present invention, if the time for which the audio signal emitted from one speaker reaches a listening point, i.e. the position of ears of a listener, equals the time for which another audio signal emitted from other speaker reaches the listening point, no undesirable phenomena occur. However, since the distance between one speaker and the listening point does not necessarily equal the distance between other speaker and the same listening point, the variation among transmission time of audio signals from each speaker included in an enclosure is apt to occur. Under such condition, when a feedback loop is established in such manner as in the above described first and second embodiments, an undesirable phenomenon is apt occur as will be described hereinbelow.

For instance, when the blocking characteristics of the low-pass filter 18 and 18' is undesirably insufficient, and/or the crossover frequency $f_1$ between the middle and low frequency ranges II and III is set at a relatively high frequency, the woofer 28 is driven by audio frequencies of middle and low frequency ranges II and III. In this case, high harmonic distortion components, due to partial vibrations of the cone (not shown) of the woofer 28, appear across the input terminals of the woofer 28 and thus a voltage indicative of the distortion components appear across the input terminals of the woofer 28. This voltage will be included in the composite signal so that the output signal of the amplifier 12 includes a compensation or correction signal which is produced in the negative feedback operation. Properly speaking, such compensation signal in the high and/or middle frequency ranges I and II should be applied to the woofer 28 in opposite phase so as to prevent the production of the distortion by the cone of the woofer 28.

However, since the frequency of the distortion components appearing across the input terminals of the woofer 28 is higher than the low frequency range III, the compensation signal passes through the band-pass filter 16 or 16' and/or the high-pass filter 14 or 14' so that the compensation signal is reproduced by the squeaker 26 and/or the tweeter 24. When such compensation signal is applied to the squeaker 26, the squeaker 26 reproduces the compensation signal together with the original audio frequencies applied to the input of the amplifier 12. It is apparent that sound emitted from the squeaker 26 includes distortion components corresponding to the compensation signal. In this case, if the sound, including the distortion components, emitted from the squeaker 26 reaches a listening point at the same time the other sound, including the distortion components, emitted from the woofer 28 reaches the listening point, viz. when the two sound waves are in phase at the listening point, the distortion originally produced by the woofer 28 is compensated for. However, if there is difference in phase between the two sound waves, the distortion is not compensated for. For instance assuming the difference between the propagation distances equals an odd multiple of the half of the wavelength of the distortion frequency, the distortion components in both sound waves are added to each other and thus the distortion is increased in the opposite manner to the case of the above mentioned compensation.

Although high harmonic distortion components are produced by the squeaker 26 and are emitted from the tweeter 24 in the same manner, the high harmonic distortion components are usually out of the audible range and thus the emitted distortion components offer no problem. Meanwhile, the high harmonic distortion components produced by the squeaker 26 are applied via the feedback circuit to the low-pass filter 18 or 18' and are blocked by the filter 18 or 18' so that the woofer 28 does not emit the distortion components produced by the squeaker 26 therefrom.

Further, since the band-pass filter 16 or 16' consists of a high-pass filter and a low-pass filter, the number of elements such as capacitors and coils included in the band-pass filter is usually greater than that of elements included in each of the high-pass filter 14 or 14' and the low-pass filter 18 or 18'. Therefore, the influence by the band-pass filter 16 or 16' per ce on the squeaker 26 is much greater than the influences by other filters on corresponding speakers. In other words, the distortion of the audio signals produced by the squeaker 26 connected to the band-pass filter 16 or 16' is greater than those of the distortion of audio signals produced by the tweeter 24 and the woofer 28. Moreover, the quality of the sound reproduced by a speaker system is usually evaluated mainly by the quality of the sound reproduced by the squeaker 26.

Hence, the inventors of the present invention provided an improved multi way speaker system in which there is no need to pay attention to the phase relationship between the distortion components emitted from the woofer 28 and a sound wave for the compensation for the distortion, emitted from the squeaker 26. The improved multi way speaker system will be described in connection with a third embodiment hereinbelow.

Figure 6:
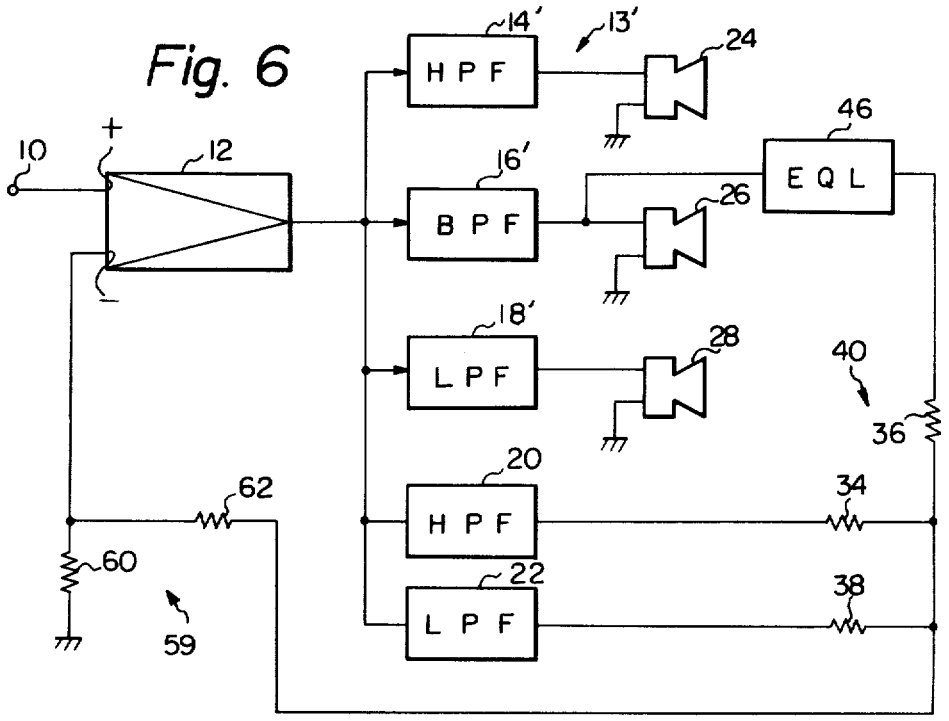
FIG. 6 shows in schematic diagram a third preferred embodiment of the multi way speaker system according to the present invention.

Reference is now made to FIG. 6 which shows a schematic diagram of the third embodiment of the multi way speaker system according to the present invention. The circuit arrangement shown in FIG. 6 is similar to the second embodiment except that only a single equalizer 46 is used while a second high-pass filter 20 and a second low-pass filter 22 are additionally provided. The input of the equalizer 46 is connected to the output of the band-pass filter 16' for receiving the output signal of the filter 16', while the output of the equalizer 46 is connected to the resistor 36 of the summing circuit 40. An input of the second high-pass filter 20 and an input of the second low-pass filter 22 are connected to the output of the amplifier 12, while the outputs of the second high-pass filter 20 and the second low-pass filter 22 are connected respectively to respective resistors 34 and 38 of the summing circuit 40. The output of the summing circuit 40, i.e. the junction connecting the three resistors 34, 36 and 38, is connected via the voltage divider 59 to the inverting input − of the amplifier 12 in the same manner as in the first and second embodiments. It is to be noted that no feedback circuit is connected to the outputs of the first high-pass filter 14' and the first low-pass filter 18'.

The attenuation slopes of the first high-pass filter 14', the band-pass filter 16' and the first low-pass filter 18' are the same as those in the second embodiment. Namely, the attenuation slopes of these filters 14', 16' and 18' are respectively 12 dB/oct and/or −12 dB/oct. However, the attenuation slopes of the second high-pass filter 20 and the second low-pass filter 22 are respectively 6 dB/oct and/or −6 dB/oct. The frequency characteristics (, i.e. the equalizing slopes,) of the equalizer 46 is 6 dB/oct and −6 dB/oct in the same manner as the second equalizer used in the second embodiment shown in FIG. 3 so that the equalizer 46 functions in the same manner as in the second embodiment to produce an output signal having attenuation slopes of 6 dB/oct and −6 dB/oct. Since the outputs of the equalizer 46, the second high-pass filter 20 and the second low-pass filter 22 are respectively connected to the respective resistors 36, 34 and 38, the three input signals of the summing circuit 40 have respectively frequency characteristics whose attenuation slopes are 6 dB/oct and/or −6 dB/oct.

It will be seen that input signals of the tweeter 24 and the woofer 28 are not fed back to the amplifier 12, while the input signal of the squeaker 26 is fed back together with the output signals of the second high-pass filter 20 and the second low-pass filter 22. Consequently, harmonic distortion components produced by the woofer 28 and/or the tweeter 24 do not have influence on other speakers. Namely, the composite signal produced by the summing circuit 40 does not include a component for compensating for the harmonic distortion components produced by the woofer 28 and the tweeter 24 and thus none of the speakers 24, 26 and 28 emit audio signals including such a compensation component.

With this provision, the damping characteristics of the squeaker 26 is improved compared to the conventional system and thus audio signals are reproduced by the three speakers 24, 26 and 28 with high-fidelity irrespectively of the listening point in the sound field.

Figure 7:
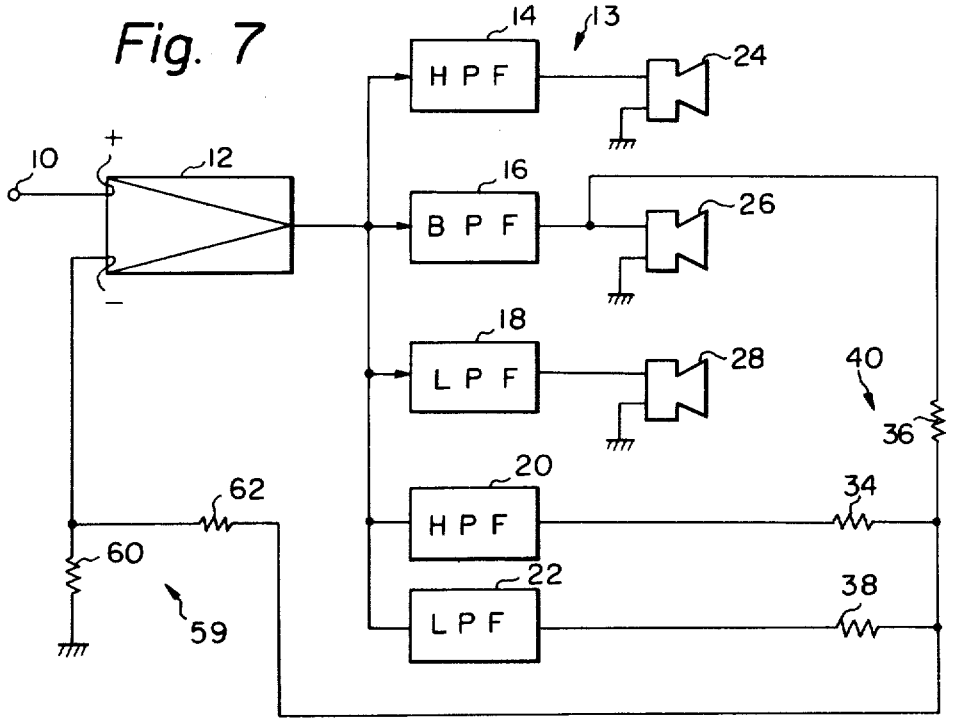
FIG. 7 shows in schematic diagram a fourth preferred embodiment of the multi way speaker system according to the present invention.

Reference is now made to FIG. 7 which shows a schematic diagram of the fourth embodiment of the multi way speaker system according to the present invention. The circuit arrangement shown in FIG. 7 is similar to that of the third embodiment except that the output of the band-pass filter 16 is directly connected to the resistor 36 included in the summing circuit 40. Further, the attenuation slopes of the high-pass, band-pass and low-pass filters 14, 16 and 18 are respectively 6 dB/oct and/or −6 dB/oct in the same manner as in the first embodiment, while the attenuation slopes of the second high-pass filter 20 and the second low-pass filter 22 are respectively 6 dB/oct and/or −6dB/oct. In the fourth embodiment, the output signal of the band-pass filter 16, i.e. the input voltage of the squeaker 26, is used to produce a composite signal in the same manner as in the third embodiment. However, since the attenuation slopes of the bandpass filter 16 is 6 dB/oct and −6 dB/oct, there is no need to provide an equalizer in the feedback loop. The function of the following stage of the summing circuit 40 is the same as that of the third embodiment and thus the description thereof is omitted.

Speakers, such as the tweeter 24, the squeaker 26 and the woofer 28 are usually disposed in a suitable enclosure having input terminals for receiving the output signal of the amplifier 12 in the same manner as in the conventional speaker system. In a conventional speaker system filters included in the frequency dividing network are usually disposed in the speaker enclosure so that only two conductive leads or wires are required to connect the output terminals of the amplifier 12 and the input terminals of the speaker enclosure. In the present invention, as described hereinabove, resistors 34, 36 and 38 included in the summing circuit 40 are additionally provided in the first embodiment, while three equalizers 44, 46 and 48 are further provided in the second embodiment. In the third and fourth embodiments, second high-pass filter 20 and the second low-pass filter 22 are additionally provided, while the voltage divider 59 is provided for all of these four embodiments. When these circuits between input terminal of the speaker enclosure for receiving the output signal of the amplifier 12 and the output terminal of the summing circuit 40 are disposed in the speaker enclosure in addition to the plurality of speakers, the amplifier 12 and the speaker enclosure may be connected via only three conductive leads. Namely, a first conductive lead is used for connecting the output terminal of the amplifier 12 to respective filters 14, 16, 18 and/or 20, 22; a second conductive lead is used for connecting the ground terminal of the amplifier 12 and the ground terminals of the speakers 24, 26 and 28; and a third conductive lead is used for connecting the output terminal of the summing circuit 40 and the voltage divider 59 to transmit the composite signal to be fed back. Although in the above described connections, the voltage divider 59 is not included in the speaker enclosure and is included in an amplifier unit (not shown) which consists of the amplifier 12 and other auxiliary circuits such as tone and volume control circuits (not shown), at least one resistor of the voltage divider 59 may be included in the speaker enclosure if desired, so that only one conductive lead is required for feeding back the composite signal or a voltage produced by diriving the voltage of the composite signal.

In the above described four embodiments, several problems may occur as will be described hereinafter. First of all, a problem may occur in connection with the phase deviation (phase rotation) of the composite signal to be fed back. Namely, although the high-pass filters 14, 14' and 20 in respective embodiments have a flat frequency characteristics in the corresponding audio frequency range, the phase deviation of a high frequency signal, such as over 100 K Hz, is quite large and thus the feedback loop is apt to oscillate when the responsive characteristics of the amplifier in such high frequency is dominant.

Secondarily, if the transmission line of the feedback signal is shielded by other transmission line the electric potential of which is of ground, high frequency audio signal in the feedback signal is attenuated to an extent due to the capacitance between the transmission lines, and thus the time delay in the high frequency range increases so that the operation of the feedback loop tends to be unstable.

Further, if the transmission lines between the amplifier 12 and the speaker unit have relatively large direct current resistances, these resistances influence the output voltage of the amplifier 12 undesirably because of the voltage drop across the transmission lines. Hence, the inventors of the present invention provide a fifth embodiment in which the above mentioned various problems will be resolved.

Figure 8:
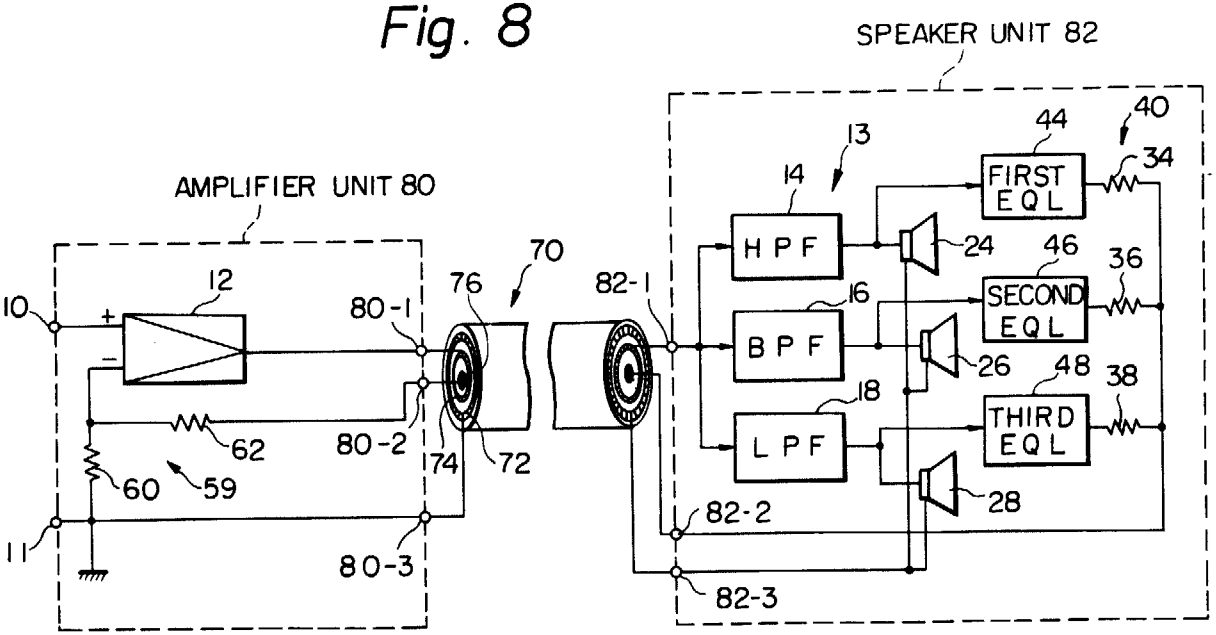
FIG. 8 shows in schematic diagram a fifth preferred embodiment of the multi way speaker system according to the present invention.

Reference is now made to FIG. 8 which shows the fifth embodiment of the multi speaker system according to the present invention. The circuit arrangement shown in FIG. 8 consists of an amplifier unit 80, a cable 70 and a speaker unit 82. The amplifier unit 80 consists of two input terminals 10 and 11 for receiving an audio signal to be amplified thereacross, three terminals 80-1, 80-2 and 80-3, the amplifier 12 and the voltage divider 59. The speaker unit 82 consists of three speakers 24, 26 and 28, frequency dividing network 13, and a stage for producing a composite signal to be fed back to the amplifier 12. Although in the fifth embodiment shown in FIG. 8, the stage for producing a composite signal comprises three equalizers 44, 46 and 48 and a summing circuit 40 in the same manner as in the second embodiment shown in FIG. 3, other circuit arrangement such as shown in FIG. 1, FIG. 6 and FIG. 7 for producing a composite signal to be fed back, may be utilized. In other words, the arrangement of the speaker unit 82 enclosed by the dotted line may be any one of the arrangements of the first to fourth embodiments described hereinbefore.

The first input terminal 10 of the amplifier unit 80 is connected to the noninverting input + of the amplifier 12, while the second input terminal 11 of the amplifier unit 80 is grounded. A resistor 60 is interposed between the inverting input − of the amplifier 12 and ground, while the other resistor 62 is interposed between the terminal 80-2 and the inverting input − of the amplifier 12. The output of the amplifier 12 is connected to the terminal 80-1, while the terminal 80-3 is grounded. All of the elements included in the speaker unit 82 are disposed in a suitable speaker enclosure, where the speaker enclosure has three terminals 82-1, 82-2 and 82-3. The first terminal 82-1 is provided for receiving the output signal of the amplifier 12 and is connected to input of the frequency dividing network 13. The second terminal 82-2 is provided for feeding back the composite signal and is connected to the output of the summing circuit 40, while the third terminal 82-3 is provided for connecting the ground terminal of the amplifier unit 80 to the ground terminals of the speakers 24, 26 and 28.

The cable 70 respectively connecting the terminals 80-1, 80-2 and 80-3 of the amplifier unit 80 to the terminals 82-1, 82-2 and 82-3 is a three-wire coaxial cable which includes three conductors. The coaxial cable 70 has an inner conductor 76 positioned at the center of the cable 70, a first outer conductive tube 74, a second outer conductive tube 72 disposed outside of the first outer tube 74 and insulating layers (no numeral) disposed between the conductors 76, 74 and 72. These first and second conductive tubes 72 and 74 may be substituted with braided wires. The inner conductor 76 is connected to the second terminal 80-2 of the amplifier unit 80 at one end and is connected to the second terminal 82-2 of the speaker unit 82 at the other end. The first outer conductive tube 74 is connected to the first terminal 80-1 of the amplifier unit 80 at one end and is connected to the first terminal 82-1 of the speaker unit 82 at the other end. The second outer conductive tube 72 is connected to the third terminal 80-3 of the amplifier unit 80 at one end and is connected to the third terminal 82-3 of the speaker unit 82 at the other end. It will be understood that since the inner conductor 76 which is for feeding back the composite signal is covered via an insulating member by the first outer conductive tube 74, the inner conductor 74 is shielded, while the first outer conductive tube 74 is used for transmitting the output signal of the amplifier 12 by connecting the hot side of the outputs of the amplifier 12, to the input of the frequency dividing network 13. In the above, "the hot side" means the output terminal of the amplifier 12 with respect to the other output terminal which is grounded.

With this provision, the electric potential of the first outer conductive tube 74 for transmitting speaker driving signals equals that of the inner conductor 76 which is used for the negative feedback circuit, or the electric potential of the first outer conductive tube 74 is higher than that of the inner conductor 76. Namely, in the above case, the equivalent circuit of the transmission line of the feedback signal is such that shown in FIG. 9.

Figure 9:
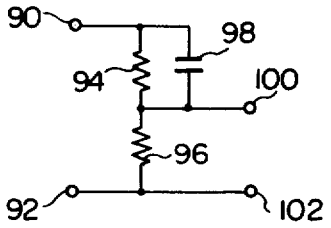
FIG. 9 shows an equivalent circuit of the feedback transmission line included in the three-wire coaxial cable shown in FIG. 8.
Figure 10:
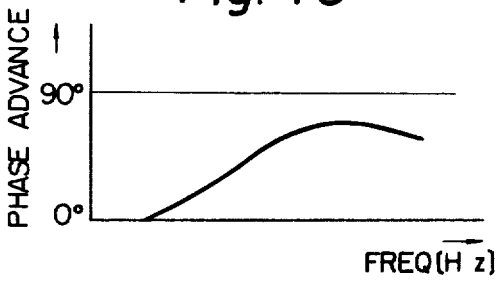
FIG. 10 shows in graphical diagram the frequency to phase characteristic of the feedback transmission line the equivalent circuit of which is shown in FIG. 9.

In the equivalent circuit shown in FIG. 9, input terminals and output terminals are respectively denoted by references 90, 92 and 100 and 102. A series circuit of two resistors 94 and 96 is interposed between the first and second input terminals 90 and 92. A capacitor 98 is connected in parallel with the first resistor 94. A junction connecting the two resistors 94 and 96 is connected to the first output terminal 100, while the second input terminal 92 and the second output terminal 102 are directly connected to each other. The capacitance of the capacitor 98 corresponds to the capacitance between the inner conductor 76 and the first outer conductor 74. Because of the capacitance between the transmission lines, the feedback signal has phase deviation characteristics as shown in FIG. 10. As shown in FIG. 10, the phase of the feedback signal, which is transmitted via the coaxial cable 70 and is obtained across the output terminals 100 and 102 of the equivalent circuit shown in FIG. 9, has a phase advance when the frequency of the feedback signal is over a predetermined value. Therefore, undesirable time delay in the transmission of the feedback signal is prevented and thus the negative feedback loop operates with high stability with the above mentioned specific connections of the terminals of the amplifier unit 80 and the terminals of the speaker unit 82.

Further, it is to be noted that the output signal of the amplifier 12 is transmitted via the first outer conductive tube 74 and the second outer conductive tube 72, where the direct current resistance of the first and second outer tubes 74 and 72 are relatively small compared to a conventional single cable inasmuch as the cross sectional area of the first and second outer conductive tubes 74 and 72 are larger than that of a single cable. The second outer conductive tube 72 is positioned outside of the first outer conductive tube 74 as described hereinbefore and therefore, the direct current resistance of the second outer conductive tube 72 is smaller than that of the first outer conductive tube 74. This is advantageous for eliminating the influence of the undesirable direct current resistance since the second outer conductive tube 72 is used for the common circuit for the transmission of the output signal of the amplifier 12 and the transmission of the feedback signal and thus the current flowing through the second conductive tube 72 is the greatest among the three lines in the three-wire coaxial cable 70.

With this arrangement, the undesirable influence due to the voltage drop across the transmission lines is effectively diminished.

Moreover, with the provision of the coaxial cable 70 the impedance of the transmission line for the output signal of the amplifier 12, is small because of a capacitance existing between the first and second outer conductive tubes 74 and 72. The low impedance of the transmission lines is suitable for driving speakers having low input impedances in view of impedance matching and damping characteristics of speakers.

When a composite signal produced by the summing circuit 40 of any one of the above described first to fifth embodiments is fed beak to the amplifier 12, the negative feedback loop is apt to suffer undesirable phenomena such as an oscillation if there is disturbance in the frequency characteristics and or the phase characteristics of the composite signal. Further, the output level of the amplifier 12 is apt to undesirably vary depending on the presence of the composite signal and the absence of the same. In order to eliminate the above mentioned undesirable operation of the negative feedback loop, the inventors of the present invention provide a suitable circuit arrangement for the multi way speaker system.

Figure 11:
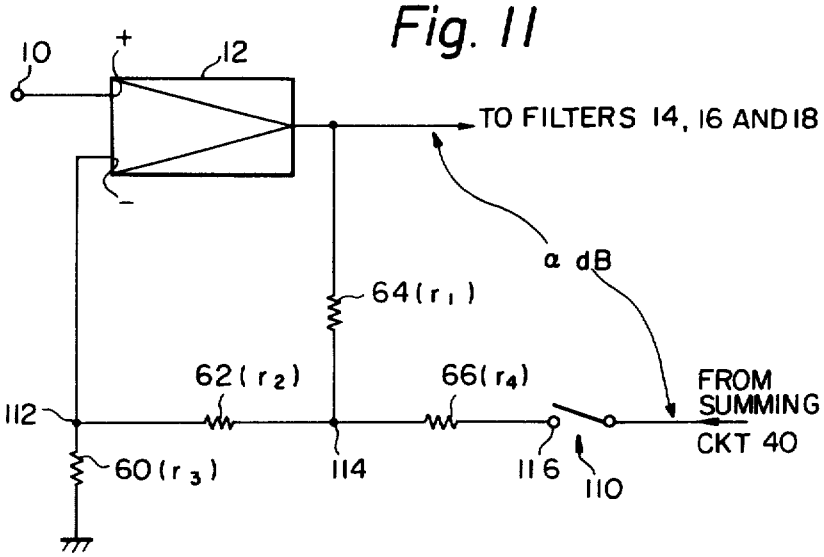
FIG. 11 shows in schematic diagram a main portion of a sixth preferred embodiment of the multi way speaker system according to the present invention.

Hence reference is now made to FIG. 11 which shows a circuit diagram used in the sixth embodiment of the multi way speaker system according to the present invention. The circuit of FIG. 11 only shows a main portion of the multi way speaker system wherein the remaining portion of the system may be any one of the arrangements of the first to fifth embodiments. The circuit arrangement shown in FIG. 11 consists of the amplifier 12, four resistors 60, 62, 64 and 66, and a switch 110. The output of the amplifier 12 is connected to respective filters included in the frequency dividing network 13 in the same manner as described in connection with the first to fifth embodiments, while the output of the summing circuit 40 is connected to one terminal of the switch 110 to feed the composite signal thereto. First, second and third resistors 64, 62 and 60 are connected in series and the series circuit of the resistors 64, 62 and 60 is interposed between the output terminal of the amplifier 12 and ground, where a junction 112 connecting the second and third resistors 62 and 60 is connected to the inverting input − of the amplifier 12, while a junction 114 connecting the first and second resistors 64 and 62 is connected via a fourth resistor 66 to the other terminal of the switch 110. The resistances of the first to fourth resistors 64, 62, 60 and 66 are respectively indicated by references $r_1$, $r_2$, $r_3$ and $r_4$.

Assuming there is no composite signal to be fed back, the switch 110 is assumed to be open (OFF). Under this condition, the gain of the circuit shown in FIG. 11 is expressed by the following equation:

$$G_1 = \frac{A}{1 + A\beta} \tag{1}$$

wherein $G_1$ is the gain of the whole circuit shown in FIG. 11;

A is the gain of the amplifier 12 when used in an open loop circuit;

$\beta$ is the feedback ratio which is expressed by $$\beta = \frac{r_3}{r_1 + r_2 + r_3}$$

Consequently, when $A >> 1/\beta$, the following relationship will be obtained.

$$G_1 = \frac{1}{\beta} = \frac{r_1 + r_2 + r_3}{r_3} \tag{2}$$

Figure 12:
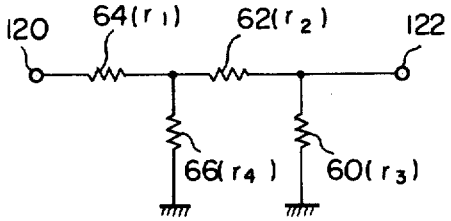
FIG. 12 shows an equivalent circuit of the resistors shown in FIG. 11.

Hence, let us take the negative feedback ratio of the multi way speaker system including the speakers 24, 26 and 28 in consideration. If the negative feedback ratio of the output signal of the amplifier 12 to the fourth resistor 66 is assumed to be expressed in terms of $\Delta G$, the gain of the amplifying circuit shown in FIG. 11 is expressed by $G_1 \times \Delta G$ when the terminal 116 of the switch 110 is grounded. When the feedback ratio under an assumption that the terminal 116 is grounded is $\beta_1$, the value of $\beta_1$ is obtained by using an equivalent circuit shown in FIG. 12 as follows. FIG. 12 illustrates the equivalent circuit in which the first and second resistors 64 and 62 are connected in series and the series circuit is interposed between an input terminal 120 and an output terminal 122, while the third resistor 60 is connected across the output terminal 122 and ground, and the fourth resistor 66 is connected across a junction connecting the first and secod resistors 64 and 62, and ground. The value of the above mentioned $\beta_1$ will be obtained by finding the magnitude of a signal at the output terminal 122, when a predetermined magnitude of a signal is applied at the input terminal 120. Therefore, the value of $\beta_1$ is expressed by the following equation.

$$\beta_1 = \frac{\dfrac{r_4(r_2 + r_3)}{r_4 + r_2 + r_3}}{r_1 + \dfrac{r_4(r_2 + r_3)}{r_4 + r_2 + r_3}} \cdot \frac{r_3}{r_2 + r_3} \tag{3}$$

When $A >> G_1 \times \Delta G$, the following equation (4) is satisfied.

$$1/\beta_1 = G_1 \times \Delta G \tag{4}$$

As a next step, assuming the gain of the feedback loop as $G_2$ upon presence of a feedback signal from the summing circuit 40 when the switch 110 is closed (ON), it is preferable that the value of the gain $G_2$ equals the value of the gain $G_1$ which is expressed by the equation (1). In other words, the amount of feedback signal applied to the inverting input − of the amplifier 12 is preferably constant irrespectively of the open and closed states of the switch 110 so that the sound pressure level of the audio frequencies emitted from the speakers 24, 26, and 28 is maintained constant irrespective of the performance of the feedback of the composite signal produced by the summing circuit 40 when the magnitude of the input audio signal fed to the noninverting input + of the amplifier 12 is constant. Assuming the attenuation constant of the circuits between the output of the amplifier 12 and the output of the summing circuit 40 as $\alpha_1$, the other attenuation ratio $\alpha_2$ of the circuits between the terminal 116 and the inverting input − of the amplifier 12 is so selected as to satisfy the following relationship.

$$\alpha_1 \cdot \alpha_2 = \beta_1 \tag{5}$$

It will be understood that the attenuation ratio $\alpha_2$ will be easily obtained in the same manner as by the equation (3).

When determining the value of the attenuation ratio $\alpha_2$, it is to be noted that it is necessary to set the value a little smaller than a value obtained by the calculation (such as 90% of the same) since not only the composite signal obtained by the summing circuit 40 but also a signal via the resistor 64 are fed back to the inverting input − of the amplifier 12. The following table shows an example of the constants for obtaining the above mentioned attenuation ratio $\alpha_2$.

$\alpha_1 = 1/5.6$ (corresponding attenuation constant is 15 dB)

$r_1 = 15K\Omega$ $r_2 = 8.2K\Omega$ $r_3 = 1.8K\Omega$ $r_4 = 1K\Omega$

It will be seen from the foregoing that in the sixth embodiment of the multi speaker system, the gain of the amplifier 12 does not change irrespectively of the open and closed condition of the switch 110. In other words, the sound pressure level of the audio frequencies emitted from the speakers 24, 26 and 28 is constant in the following three cases, viz. (1) when a speaker unit is equipped with a stage for producing the previously described composite signal and this composite signal is fed back to the amplifier 12; (2) when a speaker unit is not equipped with a stage for producing such signal to be fed back; and (3) when a speaker unit is equipped with a stage for producing such signal to be fed back but the stage is not substantially connected to the amplifier 12.

Figure 13:
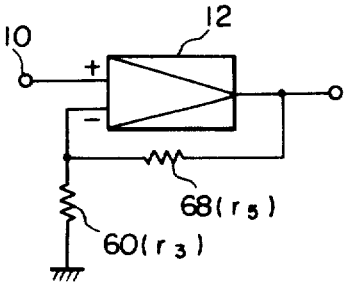
FIG. 13 shows a conventional amplifying circuit with negative feedback resistors for the sake of the explanation of the values of the resistors shown in FIG. 11.

The function of the resistors 60, 62, 64 and 66 will be described hereinafter in connection with resistors used in a conventional negative feedback amplifying circuit shown in FIG. 13. FIG. 13 shows a conventional amplifying circuit having an amplifier 12 and two resistors 60 and 68. One resistor 60 is interposed between an inverting input − of the amplifier 12 and ground, while the other resistor 68 is connected across the output of the amplifier 12 and the inverting input − of the same. An input signal is arranged to be fed to the noninverting input + of the amplifier 12 via an input terminal 10. As well known, the gain of the amplifying circuit shown in FIG. 13 is determined by the ratio of the resistances of the resistors 60 and 68. When the resistance of the resistor 60 is indicated by $r_3$ and the resistance of the other resistor 68 is indicated by $r_5$, the gain of the negative feedback amplifying circuit is expressed by $1+r_5/r_3$. Turning back to FIG. 11, when the switch 110 is in an open state, i.e. the switch 110 is turned OFF, the resistor 66 does not influence the circuit at all, and thus the gain of the amplifying circuit is determined by the resistances of the resistors 60, 62 and 64. Consequently, if the resistances $r_2$ and $r_1$ of the resistors 62 and 64 are selected to satisfy the following relationship, the gain of the amplifying circuit equals that of the conventional amplifying circuit shown in FIG. 13.

$$r_1+r_2=r_5$$

As described hereinbefore, when the terminal 116 of the switch 110 is grounded, the gain of the amplifying circuit shown in FIG. 11 increases as much as $\Delta G$, and thus the amount $\Delta G$ of the increase in gain may be the value of feedback ratio of the composite signal to be fed back from the summing circuit 40. When the feedback ratio $\Delta G$ of the composite signal is too large, the feedback loop is apt to oscillate, while the feedback ratio $\Delta G$ of the composite signal is too small, it is meaningless to feedback the composite signal. For this reason, the feedback ratio $\Delta G$ of the composite signal is selected at a suitable value, such as 20 dB when expressed in terms of attenuation constant.

With this arrangement, when a signal is applied to the terminal 116 of the switch 110, the voltage in the negative feedback loop is controlled in accordance with the voltage of the signal. It will be seen from the foregoing, that the amplifying circuit shown in FIG. 11 functions in the same manner as a conventional negative feedback amplifier shown in FIG. 13 when the switch 110 opens, while the amplifying circuit shown in FIG. 11 functions as a negative feedback amplifying circuit by feeding back a predetermined amount of the composite signal, such as 20 dB when expressed in terms of an attenuation constant of the circuits between the output of the amplifier 12 and the terminal 116, so as to apply the feedback signal to the input of the amplifying circuit.

Since the output terminals of the amplifying circuit may be connected to various types of speaker units which have different characteristics in the amount of signal to be fed back, the amount of signal to be fed back to the amplifying circuit from the speaker unit should be limited below a predetermined value so as to prevent undesirable results such as oscillation.

In FIG. 12, though the switch 110 is employed for selectively supplying the feedback signal to the amplifier 12, the switch is not essential for the circuit. In other words, the resistor 66 may be directly connected to the output of the summing circuit 40 for receiving the composite signal produced therein.

From the foregoing, it will be understood that the multi way speaker system according to the present invention reproduces audio frequencies with high fidelity especially eliminating undesirable influences by various elements included in the filters. The multi way speaker systems according to the present invention have been described hereinabove by means of specific embodiments employing thress speakers, i.e. a tweeter 24, a scoker 26 and a woofer 28. However, it will be seen that the present invention is not limited to such a three way speaker system, and other multi way such as two way and four way speaker systems may be constructed in the same manner. Obviously, many modifications and variations of the present invention are possible in the light of the above teachings. It is therefore, to be understood that within the scope of the appended claims the invention may be practiced otherwise than as specifically described.

What is claimed is:

1. A method of driving a multi way speaker system comprising the steps of:

(a) amplifying an audio signal;

(b) dividing the amplified audio signal into a plurality of frequency ranges;

(c) driving a plurality of speakers the frequency characteristics of which respectively correspond to said frequency ranges, by the divided audio signals respectively;

(d) producing a composite signal by combining at least two of the divided audio driving signals with each other; and (e) feeding said composite signal back to a stage which carries out said step of amplifying said audio signal so as to establish a negative feedback loop.

2. A method as claimed in claim 1, wherein said step of producing said composite signal comprises a step of adding the divided audio signals to each other.

3. A method as claimed in claim 1, wherein said step of producing said composite signal comprises a step of equalizing the divided audio signals and a step of adding the equalized signals to each other.

4. A method as claimed in claim 1, wherein said step of producing said composite signal comprises a step of equalizing at least one of the divided audio signals and a step of adding the equalized signal to at least one divided audio signal other than said divided audio signal to be equalized.

5. A method as claimed in claim 1, further comprising the steps of transmitting the amplified audio signal to a stage of dividing the amplified audio signal and transmitting said composite signal back to the stage of amplifying, the transmission of said amplified audio signal and said composite signal being performed by a three-wire coaxial cable such that said composite signal is fed through a conductor which is shielded by another conductor carrying said amplified audio signal.

6. A method as claimed in claim 1, further comprising a step of feeding said amplified audio signal back to a stage which carries out said step of amplifying.

7. An apparatus for driving a multi way speaker system comprising:

(a) an audio amplifier for amplifying an audio signal;

(b) a frequency dividing network responsive to the output signal of said amplifier for dividing the amplified signal into a plurality of frequency ranges;

(c) a plurality of speakers responsive to the output signals of said frequency dividing network;

(d) means for producing a composite signal by combining at least two of the speaker driving signals supplied by said frequency dividing network with each other; and (e) means for feeding said composite signal back to said amplifier so as to establish a negative feedback loop.

8. An apparatus as claimed in claim 7, wherein said means for producing said composite signal comprises a summing circuit including a plurality of resistors respectively responsive to each output signal of filters included in said frequency dividing network.

9. An apparatus as claimed in claim 7, wherein said means for producing said composite signal comprises a plurality of equalizers respectively responsive to each output signal of filters included in said frequency dividing network, and a summing circuit including a plurality of resistors responsive to each output of said equalizers respectively.

10. An apparatus as claimed in claim 7, wherein said frequency dividing network comprises first and second groups of frequency filters respectively responsive to said amplified audio signal, said first group of frequency filters dividing the amplified signal into a plurality of frequency ranges so as to drive corresponding speakers respectively, said first group of filters including a filter for transmitting a middle-frequency range signal, said second group of frequency filters transmitting signals other than said middle-frequency range signal, and wherein said means for producing said composite signal comprises at least one equalizer responsive to said middle-frequency range signal transmitted via said filter included in said first group, and a summing circuit including a plurality of resistors, at least one of said resistors being responsive to the output signal of said equalizer, while the remaining resistors are respectively responsive to the output signals of said filters of said second group.

11. An apparatus as claimed in claim 7, wherein said frequency dividing network comprises first and second groups of frequency filters respectively responsive to said amplified audio signal, said first group of frequency filters dividing the amplified signal into a plurality of frequencya ranges so as to drive corresponding speakers respectively, said first group of filters including a filter for transmitting a middle-frequency range signal, said second group of frequency filters transmitting signals other than said middle-frequency range signal, and wherein said means for producing said composite signal comprises a summing circuit inducing a plurality of resistors respectively responsive to an output signal of said filter which transmits said middle-frequency range signal and output signals of said filters included in said second group.

12. An apparatus as claimed in claim 7, further comprising a three-way coaxial cable for connecting terminals of said amplifier and terminals of a speaker unit including said frequency dividing network, said plurality of speakers, and said means for producing said composite signal, said three-way coaxial cable comprising an inner conductor positioned at the center of the cable, a first outer conductive portion, a second outer conductive portion disposed outside of said first outer conductive portion and insulating layers disposed between the conductors, said inner conductor feeding said composite signal back to said audio amplifier, said first outer conductive portion feeding the output signal of said audio amplifier to said frequency dividing network, said second outer conductive portion connecting together a ground terminal of said audio amplifier and ground terminals of said speakers.

13. An apparatus as claimed in claim 7, wherein said means for feeding said composite signal back to said amplifier comprises a voltage divider including first and second resistors, said first resistor being connected between the output of said composite signal producing means and an inverting input of said amplifier the noninverting input of which is responsive to an input audio signal, said second resistor being connected between said inverting input of said amplifier and ground.

14. An apparatus as claimed in claim 7, wherein said means for feeding said composite signal back to said amplifier comprises first, second, third and fourth resistors, said first, second and third resistors being connected in series and interposed between the output of said amplifier and ground in a direction that said first resistor is connected to said output of said amplifier and said third resistor is connected to ground, a junction connecting said second and third resistors being connected to an inverting input of said amplifier and noninverting input of which is responsive to an input audio signal to be amplified, said fourth resistor being interposed between the output of said composite signal producing means and a junction connecting said first and second resistors.

15. An apparatus as claimed in claim 14, further comprising a switch interposed between the output of said composite signal producing means and said fourth resistor.

16. An apparatus as claimed in claim 8, wherein said filters have response slopes selected from the values 0 dB/oct, 6 dB/oct or −6 dB/oct.

17. An apparatus as claimed in claim 9, wherein said filters have response slopes selected from the values 0 dB/oct, 12 dB/oct or more, or −12 dB/oct or less, and wherein said equalizers have characteristics opposite to the attenuation slopes of said filters, the equalization slopes of said equalizers being so selected that each of the resultant slopes respectively made by the attenuation slopes of the equalization slopes equals 6 dB/oct or −6 dB/oct.

18. An apparatus as claimed in claim 10, wherein said filters in said first group have response slopes of 0 dB/oct, 12 dB/oct or more, or −12 dB/oct or less, and wherein said equalizer has characteristics opposite to the attenuation slopes of said filter which transmits said middle-frequency range signal, and wherein said filters in said second group have response slopes selected from the values 0 dB/oct, 6 dB/oct or −6 dB/oct.

19. An apparatus as claimed in claim 11, wherein said filters in said first and second groups have response slopes selected from the values 0 dB/oct, 6 dB/oct or −6 dB/oct.

20. An apparatus for driving a multi way speaker system comprising:

(a) an audio amplifier for amplifying an audio signal;

(b) a frequency dividing network responsive to the output signal of said amplifier for dividing the amplified signal into high, middle and low frequency ranges, said frequency dividing network including a high-pass filter, a bandpass filter and a low-pass filter for respectively transmitting a high-frequency range signal, a middle-frequency range signal and a low-frequency range signal, said high-pass filter having an attenuation slope of 6 dB/oct in a range below a crossover frequency between said high-frequency range and said middle frequency range, said band-pass filter having a first attenuation slope of −6 dB/oct in a range over said crossover frequency between said high and middle frequency ranges and a second attenuation slope of 6 dB/oct in a range below another crossover frequency between said middle-frequency range and said low-frequency range, said low-pass filter having an attenuation slope of −6 dB/oct in a range over said another crossover frequency between said middle and low frequency ranges;

(c) speakers including a tweeter responsive to the output signal of said high-pass filter, a squeaker responsive to the output signal of said bandpass filter and a woofer responsive to the output signal of said low-pass filter;

(d) a summing circuit including first, second and third resistors respectively responsive to the output signals of said filters, said first, second and third resistors being connected to each other at one end thereof so as to produce a composite signal at a junction connecting said resistors;

(e) a voltage divider responsive to said composite signal for feeding said composite signal back to an input of said amplifier so as to establish a negative feedback loop.

21. An apparatus for driving a multi way speaker system comprising:

(a) an audio amplifier for amplifying an audio signal;

(b) a frequency dividing network responsive to the output signal of said amplifier for dividing the amplified signal into high, middle and low-frequency ranges, said frequency dividing network including a high-pass filter, a bandpass filter and a low-pass filter for respectively transmitting a high-frequency range signal, a middle-frequency range signal and a low-frequency range signal, said high-pass filter having an attenuation slope of 12 dB/oct in a range below a crossover frequency between said high-frequency range and said middle frequency range, said bandpass filter having a first attenuation slope of −12 dB/oct in a range over said crossover frequency between said high and middle frequency ranges and a second attenuation slope of 12 dB/oct in a range below another crossover frequency between said middle-frequency range and said low-frequency range, said low-pass filter having an attenuation slope of −12 dB/oct in a range over said another crossover frequency between said middle and low frequency ranges;

(c) speakers including a tweeter responsive to the output signal of said high-pass filter, a squeaker responsive to the output signal of said bandpass filter and a woofer responsive to the output signal of said low-pass filter;

(d) first, second and third equalizers respectively responsive to the output signals of said high-pass, bandpass and low-pass filters, said equalizers have inverse characteristics in said frequency ranges to the attenuation slopes of said filters, said first equalizer having an equalization slope of −6 dB/oct in a range below said crossover frequency between said high and middle frequency ranges, said second equalizer having a first equalization slope of 6 dB/oct in a range over said crossover frequency between said high and middle frequency ranges and a second equalization slope of −6 dB/oct in a range below said another crossover frequency between said middle and low frequency ranges, said third equalizer having an equalization slope of 6 dB/oct in a range over said another crossover frequency;

(e) a summing circuit including first, second and third resistors respectively responsive to the output signals of said first, second and third equalizers, said first, second and third resistors being connected to each other at one end thereof so as to produce a composite signal at a junction connecting said resistors;

(f) a voltage divider responsive to said composite signal for feeding said composite signal back to an input of said amplifier so as to establish a negative feedback loop.

22. An apparatus for driving a multi way speaker system comprising:

(a) an audio amplifier for amplifying an audio signal;

(b) a frequency dividing network responsive to the output signal of said amplifier for dividing the amplified signal into high, middle and low frequency ranges, said frequency dividing network including first and second high-pass filters, a bandpass filter and first and second low-pass filters for respectively transmitting a high-frequency range signal, a middle-frequency range signal and a low-frequency range signal, said first and second high-pass filters respectively having attenuation slopes of 12 dB/oct and 6 dB/oct in a range below a crossover frequency between said high-frequency range and said middle frequency range, said bandpass filter having a first attenuation slope of −12 dB/oct in a range over said crossover frequency between said high and middle frequency ranges and a second attenuation slope of 12 dB/oct in a range below another crossover frequency between said middle-frequency range and said low-frequency range, said first and second low-pass filters respectively having attenuation slopes of −12 dB/oct and −6 dB/oct in a range over said another crossover frequency between said middle and low frequency ranges;

(c) speakers including a tweeter responsive to the output signal of said first high-pass filter, a squeaker responsive to the output signal of said bandpass filter and a woofer responsive to the output signal of said first low-pass filter;

(d) an equalizer responsive to the output signal of said bandpass filter, said equalizer having inverse characteristics in corresponding frequency ranges to the attenuation slopes of said bandpass filter, a first equalization slope of 6 dB/oct in a range over said crossover frequency between said high and middle frequency ranges and a second equalization slope of −6 dB/oct in a range below said another crossover frequency between said middle and low frequency ranges;

(e) a summing circuit including first, second and third resistors respectively responsive to the output signal of said equalizer, said second high-pass filter and said second low-pass filter, said first, second and third resistors being connected to each other at one end thereof so as to produce a composite signal at a junction connecting said resistors;

(f) a voltage divider responsive to said composite signal for feeding said composite signal back to an input of said amplifier so as to establish a negative feedback loop.

23. An apparatus for driving a multi way speaker system comprising:

(a) an audio amplifier for amplifying an audio signal;

(b) a frequency divider network responsive to the output signal of said amplifier for dividing the amplified signal into high, middle and low frequency ranges, said frequency dividing network including first and second high-pass filters, a bandpass filter and first and second low-pass filters for respectively transmitting a high-frequency range signal, a middle-frequency range signal and a low-frequency range signal, said first and second high pass filters respectively having attenuation slopes of 6 dB/oct in a range below a crossover frequency between said high-frequency range and said middle frequency range, said bandpass filter having a first attenuation slope of −6 dB/oct in a range over said crossover frequency between said high and middle frequency ranges and a second attenuation slope of 6 dB/oct in a range below another crossover frequency between said middle-frequency range and said low-frequency range, said first and second low-pass filters respectively having attenuation slopes of −6 dB/oct in a range over said another crossover frequency between said middle and low frequency ranges;

(c) speakers including a tweeter responsive to the output signal of said first high-pass filter, a squeaker responsive to the output signal of said bandpass filter and a woofer responsive to the output signal of said first low-pass filter;

(d) a summing circuit including first, second and third resistors respectively responsive to the output signals of said bandpass filter, said second high-pass filter and said second low-pass filter, said first, second and third resistors being connected to each other at one end thereof so as to produce a composite signal at a junction connecting said resistors;

(e) a voltage divider responsive to said composite signal for feeding said composite signal back to an input of said amplifier so as to establish a negative feedback loop.

* * * * *